United States Patent [19]

Coakley et al.

[11] 4,348,058

[45] Sep. 7, 1982

[54] METHOD AND APPARATUS FOR SLURRY BOREHOLE MINING

[75] Inventors: John E. Coakley, Westfield; James J. Nolan, Brielle, both of N.J.

[73] Assignee: Slurry Mining Engineering Inc., Westfield, N.J.

[21] Appl. No.: 136,283

[22] Filed: Apr. 1, 1980

[51] Int. Cl.[3] ..... E21C 45/00; E21C 37/12

[52] U.S. Cl. ..... 299/17; 175/67; 175/213; 299/64

[58] Field of Search ..... 299/17, 1; 175/67, 213

[56] References Cited

U.S. PATENT DOCUMENTS

| | | | |
|---|---|---|---|
| 3,439,953 | 4/1969 | Pfefferle | 299/17 |
| 3,477,526 | 11/1969 | Jones et al. | 175/38 X |
| 3,552,502 | 1/1971 | Wilson | 175/38 X |
| 3,747,696 | 7/1973 | Wenneborg et al. | 299/17 |
| 4,171,187 | 10/1979 | Reed | 175/213 X |

*Primary Examiner*—Ernest R. Purser
*Attorney, Agent, or Firm*—John E. Coakley

[57] ABSTRACT

A method and apparatus is provided for recovering deep subterranean ore deposits using conventional dual conduit pipe in the tool string. The drill cuttings and ore are returned to the surface by reverse circulation. A combination drilling and mining head is disclosed which permits the outer casing to be driven by the power swivel during both the drilling and mining operations. A hydraulic eductor pump located at the suction entrance to the inner conduit is used to raise drill cuttings to the surface; a separate slurry eductor pump within the inner conduit located only sufficiently below the slurry discharge of the tool to prevent cavitation at the jet is used to pump the ore slurry to the surface. Another embodiment of this invention employs both eductors to raise the drill cuttings and ore slurry to the surface. Valves controlling the flow of fluid to the drill bit, the mining jet and the slurry discharge eductor pump are located within the inner conduit and a novel valve actuating means is disclosed which employs the pressure within the annular space between the conduits to convert the tool from the drilling to the mining mode. Surface mounted flow control valves and flowmeters in the fluid feed line and in the slurry discharge line control the volume of fluid entering and discharging from the tool. These valves may be controlled by instrumentation to balance the flows, adjusted to control the mining cavity pressure or to compensate for the influx of ground water.

25 Claims, 13 Drawing Figures

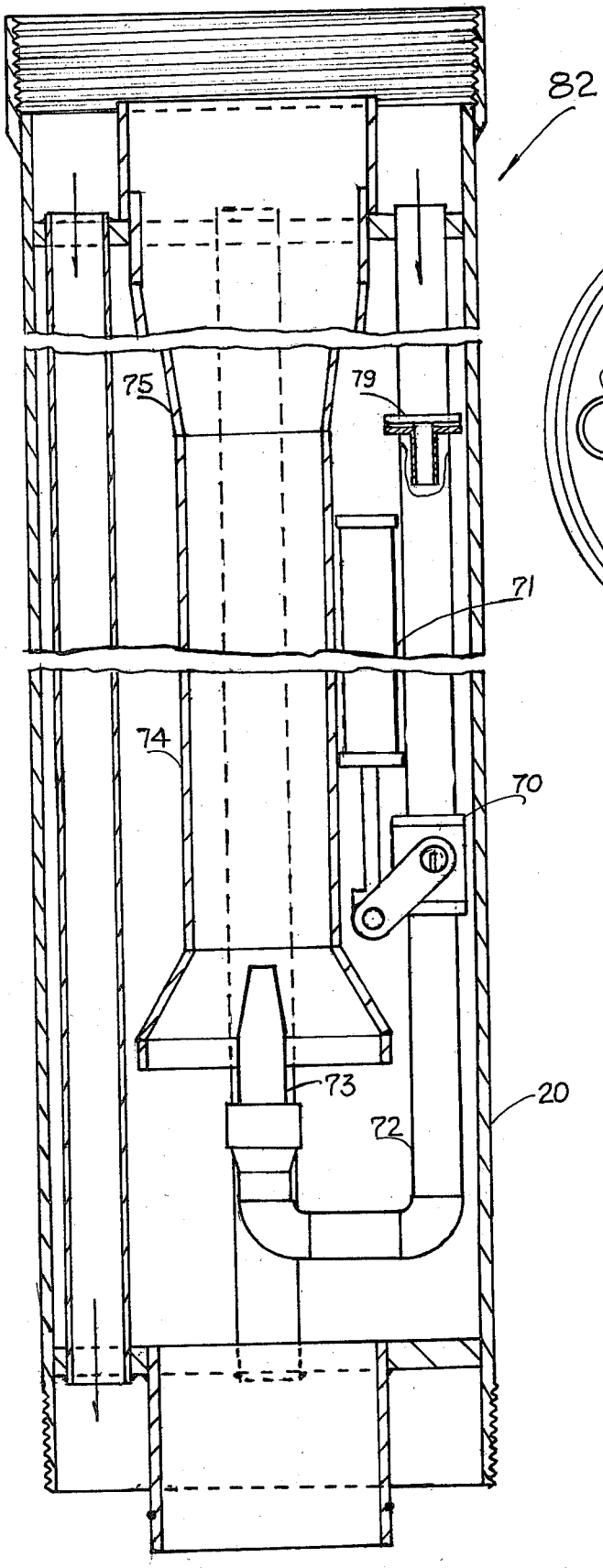
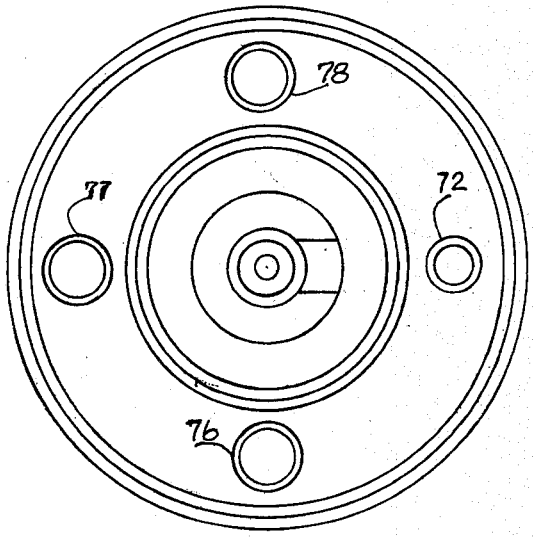
FIG. 5A
FIG. 5

FIG. 7A
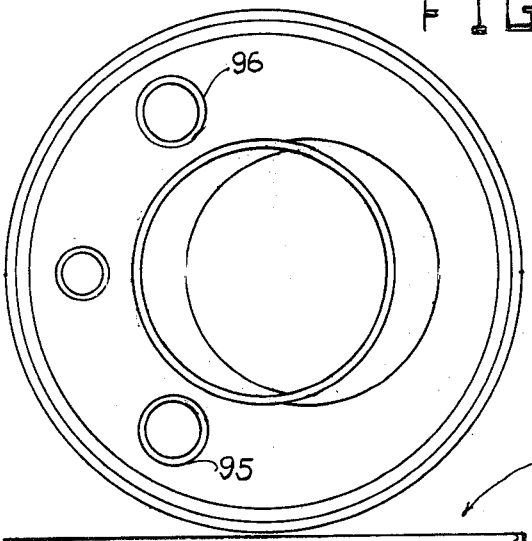
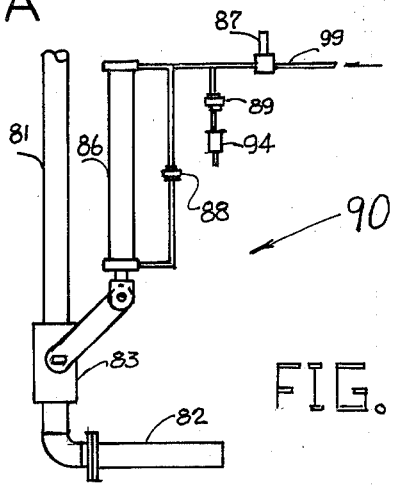
FIG. 8A
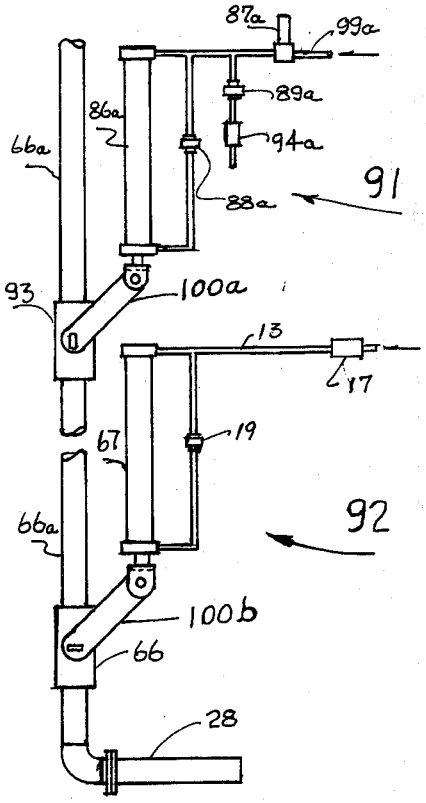
FIG. 8
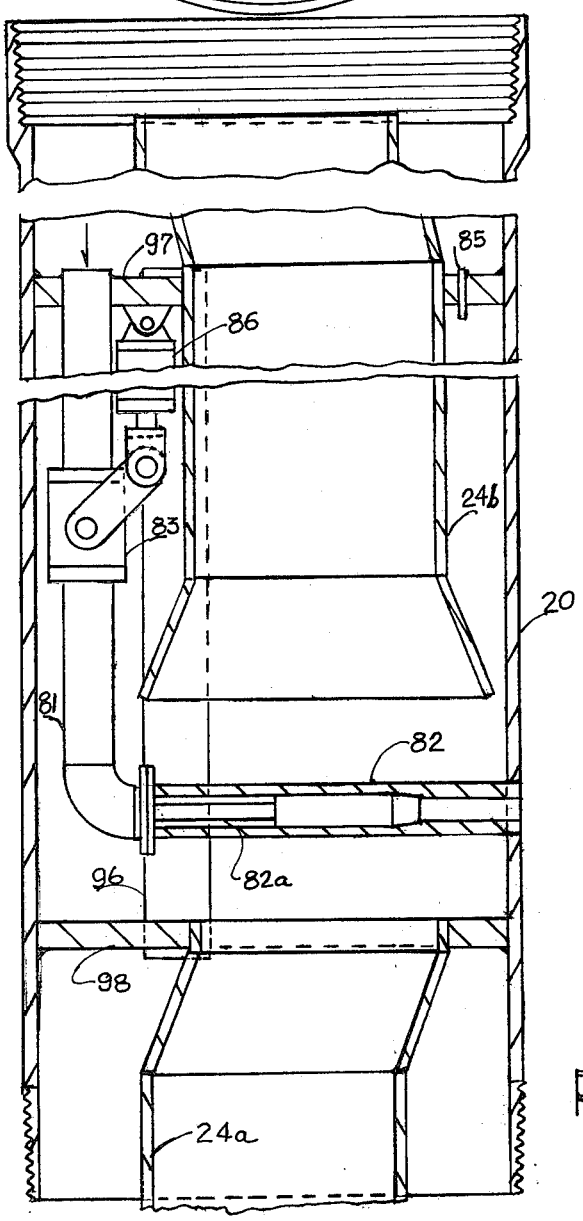
FIG. 7

METHOD AND APPARATUS FOR SLURRY BOREHOLE MINING

BACKGROUND OF THE INVENTION a. Field of the Invention

This invention pertains to improvements in slurry borehole mining and more particularly relates to a drilling and mining method and apparatus for recovering deep subterranean deposits of ore with a dual conduit drill pipe wherein the drilling and mining fluid is directed into the annular section between the conduits and the drill cuttings and slurry are returned to the surface in the inner conduit; a hydraulic jet pump located intermediate of the mining tool section and the slurry discharge is used to pump the ore slurry to the surface. A hydraulic jet pump located at the base of the tool pumps drill cuttings during the drilling mode through the inner conduit to the surface.

b. Description of the Prior Art

Subterranean ore deposits have been discovered that cannot be mined by conventional mining apparatus or methods, particularly where a water table is encountered. Various methods have been used in attempts to recover granular ore deposits at depths of 150 to 300 ft.; prior art methods employing a hydraulic jet pump for the ore slurry have had a practical depth limit of 500 ft. The methods and apparatus used in these experiments resulted in subsidence of large quantities of overburden into the initial ore cavity and with the tool pumping the overburden to the surface.

Hydraulic borehole mining of ore is broadly known in the art as evidenced by the following United States Patents:

U.S. Pat. Nos. 3,155,177 and 3,316,985 issued to A. B. Fly on Nov. 3, 1964 and May 2, 1967 respectively teach a method and apparatus for slurry mining through a borehole which may be changed between its drilling mode of operation and its mining mode of operation to mine several different stratas without removing the tool string from the borehole. The drill string is equipped with a conventional drill bit enabling the machine to drill through hard formations; the drill bit being driven by a hydraulic drilling device. The gross suspended weight of the drill string or any portion thereof can be applied to the roller bit to facilitate optimum drilling rates. The invention teaches the essential controls needed to convert from drilling to mining, i.e., mining nozzle flow, eductor nozzle flow and fluid flow to the drill bit each with a drilling mode and a mining mode of operation. Electric motors within the tool string operate the valves to convert the apparatus from the drilling mode to the mining mode of operation while the tool is still in the borehole. The inventor anticipates jetting the matrix in air; the fluid level in the bore or well cavity being maintained below the mining jets and above the eductor pump opening for optimum operation. The hydraulic eductor located below the mining nozzle is subject to cavitation at the extreme venturi velocities that are needed for maximum pumping depths and acts to limit the practical depth (500 Ft.) to which the tool can be used.

U.S. Pat. No. 2,518,591 which issued to Aston et al on Aug. 15, 1950 discloses a jet mining and excavating apparatus wherein water jets are used to sink boreholes into alluvial soils and the inventor expressly anticipates the use of a combined sinking and excavating unit and additionally anticipates the use of the usual boring means instead of washing to produce boreholes in hard ground or rock extending to the mineralized zone. The apparatus employes a water jet to slurrify the ore and a eductor to raise the slurry to the surface. When the borehole reaches the mineralized stratum, the sinking unit is removed and an excavating unit substituted therefore.

U.S. Pat. Nos. 3,730,592 issued May 1, 1973 and 3,747,696 issued July 24, 1973 to Wenneborg et al discloses a method and apparatus for borehole mining wherein the drilling and mining fluid is pumped from the surface through an annulus in the tool string and two distinct paths are employed to return the fluid to the surface; while drilling the fluid is returned externally of the tool through the space between the tool and the wellbore to 'wash' the cuttings to the surface, during mining fluid is directed into the orebody to form a slurry and the slurry is pumped to the surface within the tool by an eductor located above the foot valve and adjacent to the slurry entrance to the tool. The mining nozzle is located above the diffuser section of the eductor and attacks the orebody at the top of the strata. An important feature of this disclosure is that the hydraulic actuating force for changing the function of the tool from drilling to mining is transmitted from the surface and that the actuating fluid line is located wholly within the fluid supply passage to the lower tool section; the hydraulic valve operating means is used to operate the mining nozzle, foot valve and a slurry eductor located at the base of the tool at the slurry entrance.

U.S. Pat. No. 4,035,023 filed July 15, 1975 and issued July 12, 1977 to Clifford Cockrell discloses the use of a rotatable concentric dual-conduit tool string with Hydril type screwed joints wherein the first fluid is directed down the annular space between the conduits and the slurry is returned to the surface through the inner conduit. The cavity is subjected to air pressure sufficient to raise the slurry to the surface via the slurry discharge conduit. A foot valve controls the volume of slurry rising to the surface and is hydraulically operated by the differential pressure between the vented cavity pressure at the base of the tool and the hydraulic pressure supplied by a slurry level controller.

In a modified embodiment of the invention a turbine driven multi-stage slurry pump is used to pump the slurry to the surface. An auxiliary air lift means can be used to assist lifting the slurry to the ground level.

In this disclosure Cockrell is the first to teach a principle of self-activating down-hole hydraulic valves for tool control; he is first to disclose, describe and use the differential pressure between a control pressure equivalent to or less than system pressure and the vented cavity pressure to establish a hydraulic actuating force for down-hole hydraulic valve control. Cockrell is also first to teach, describe and use the differential hydraulic actuating force between a control pressure and the cavity pressure to modulate down-hole control valves.

U.S. Pat. No. 4,059,166 of Nov. 22, 1977 and No. 4,067,617 of Jan. 10, 1978 issued to P. R. Bunnelle disclose a method and apparatus for slurry mining with one or more mining nozzles disposed above the eductor. Two distinct paths are used to return the fluid pumped to the tool in the well bore; during drilling the fluid and cuttings are returned externally of the tool string through the space between the tool and the well bore, while during mining the ore slurry is returned within the tool. Several different hydraulic control systems are disclosed to convert the down-hole tool from drilling to mining all with valve control means located within the fluid supply passage of the tool. A separate drilling head and mining head are used in this disclosure. A control system employing a hydraulic conduit extending to the surface is used to modulate the eductor nozzle to control the cavity pressure; control systems activated by the difference between the pump pressure and a vented or cavity pressure are also employed. Self-activating systems to modulate the eductor nozzle also employ the pressure difference between a control pressure and a vented cavity pressure for valve actuation. Separate control systems are employed for the eductor and the foot valve. An important feature of these systems is that the valve actuating control pressure and the drilling pressure are the same during drilling while during mining the valve actuating control pressure is established by venting to the cavity pressure or to the atmosphere.

U.S. Pat. No. 4,077,671 of Mar. 7, 1978 and No. 4,077,481 of Mar. 7, 1978 issued to P. R. Bunnelle disclose a method and apparatus for a combination drilling and mining tool wherein the drilling water is directed through the outer annular conduit and through a tool bit foot valve to flush the cuttings upwardly to the surface externally of the tool between the drill string and the borehole; after drilling a mining head replaces the drilling head on the upper end of the drill string which also provides hydraulic control means for changing the tool function from drilling to mining and for certain modes of tool operation. When the ore is recovered from one elevation and it is desired to remove ore from a deeper strata, the mining head is removed and replaced by a drilling head, additional pipe sections being added until the lower strata is encountered; the drill head must then be removed and replaced by a mining head before ore recovery is initiated. In another embodiment two mining nozzles are assembled into the tool string each at different elevations to permit mining two strata of ore from different levels. Hydraulic valve control systems are located wholly within the fluid supply passage of the tool.

A modified valve control system is provided which is self-activating by responding to the pressure differential between the system pressure and the pressure in the well cavity. An important feature of this method is that during the drilling mode the valve actuating control pressure and the drilling pressure are the same while during the mining mode the valve actuating control pressure is established by venting to the atmosphere or to the cavity pressure.

The practical application of this tool is limited to recovering ore deposits at depths up to 500 Ft. based on its ability to pump commercial quantities of ore to the surface.

Other patents relating to apparatus or methods for mining slurrified ore but appearing to be less pertinent include: U.S. Pat. Nos. 3,311,414; 3,439,953; 4,140,346; 3,623,558; 3,797,590; 3,030,086 and 4,134,619.

SUMMARY OF THE INVENTION

The present invention provides a combination borehole drilling and slurry mining apparatus for recovering ore from deep subterranean deposits and a method of operating the same. The apparatus consists of a dual-conduit tool string with a combination drilling and mining head which engages in screwed connection to the uppermost and outermost section of the drill string and allows the tool to be rotated by the power swivel during both the drilling and mining operations. The drilling and mining head is supported from a vertically movable hoist on a drilling derrick or mast capable of raising or lowering the drill string to contact the ore matrix at any desired level; a lateral connection on the stationary element of this head connects to the annular space between the conduits for supplying drilling and mining fluid to the tool string, the center conduit is connected through a swivel for discharging drill cuttings during the drilling cycle and ore slurry during the mining mode.

Operation of this novel drilling and mining head is made possible by the novel arrangement of the seals. Close dimensional tolerances are extremely important in high pressure seals. Seals surrounding and in contact with the circumference of the drill collar are subject to the variations due to out-of-roundness of the mating surfaces and the run-out and play incorporated in the bearings with no means of compensating for these dimensional clearances or provision to compensate for wear. Our method mounts the seals in the recesses of a flat surface extending radially from the axis of the drill string to have the lip seals rub on the stationary flat surface of the mating fluid supply manifold; the seals could also be installed in the stationary manifold as well. The seal housing on the lower radial flange below the fluid supply manifold is provided with a take-up to preload the bearings sufficiently to remove the bearing play. Out-of roundness and bearing run-out are minimized by the seals rubbing on the flat radial surface. A single seal or multiple seals can be used. When more than one seal is used, reduced manifold pressure from a regulator can be directed between the seals to minimize the pressure drop across each seal; a small bleed orifice in the line after the regulator is employed to releave this pressure when the pressure in the manifold decreases. The capacity of the regulator being adequate to hold the pressure between the seals while a small volume is discharged through the bleed orifice. While lip seals are shown on the drawings it will be appreciated that other types of seals could also be employed.

The tool string has a drill bit and underreamer as its drilling head for drilling a borehole from the surface to a subterranean deposit of ore. The lower tool section contains slurry entrance openings with grills for excluding large particles and the openings are connected to the inner conduit for transporting drill cuttings and ore slurry to the surface; two eductor pumps each consisting of a high velocity fluid jet, a mixing throat and diffuser section are contained within the inner conduit. The first or lower eductor pump is located at the base of the tool adjacent to the slurry entrance openings and is primarily used to pump drill cuttings to the surface during the drilling cycle with the valve that controls the fluid flow to this eductor nozzle closed during the mining cycle. A second or slurry eductor is used primarily when operating with the cavity flooded and is located intermediate of the mining tool section and below the liquid level in the borehole to pump drill cuttings and or slurry to the surface. Drilling system and or mining system pressure is pumped through the eductor nozzle during each mode of operation. A mining nozzle flow control valve, normally closed during drilling and open during mining controls the flow of fluid to the mining nozzle which ejects the mining fluid transversely of the tool to reduce the ore to a slurry.

A novel down-hole valve actuating mechanism is used to operate the flow control valves; the pressure in the annular space between the conduits is imposed on each side of the piston-cylinder valve actuators. During drilling when the pressure used can vary from 200 to 350 p.s.i.g., the piston is held in the retracted or head end of the cylinder by a spring which maintains the normal position of the valve at this system pressure. During mining the supply or system pressure is increased to approx. 800 psig or higher for specific mining applications which forces the piston against the urging of the spring toward and against the stop within the cylinder by the total pressure difference across the piston produced by the differential area on which the pressure is exerted. The basis for the differential area of pressure being a reduced area on the rod side of the piston which has only the pressure within the discharge conduit acting on the rod extended through the cylinder. The position of the stop within the cylinder is made to allow 90 degrees of travel of the control valve handle. Tubing connected to each side of the cylinder conveys the system pressure to each side of the piston; an orifice in the line between the cylinder ends controls the rate of travel of the piston and thereby the rate of opening and closing of the valve to reduce water hammer in the system.

The control valve actuators are within the discharge conduit of the tool string and use the supply pressure within the annular space between the conduits to actuate the down-hole control valves. The slurry eductor and also a seperate mining nozzle section used in this invention are located intermediate of the lower mining section and the liquid level in the borehole; the use of control conduits to these functions would be impractical.

It will be understood, however, that the control valve actuators used on the down-hole valves could be made to function with the rod end of the cylinder vented to the pressure within the discharge conduit with a filter in the vent line and with the supply fluid pressure applied to the head end of the cylinder with an orifice in the conduit to control the velocity of valve actuation and with the normal position of the valve being maintained by the spring during the application of drilling system pressure to the head end of the cylinder and with mining system pressure forcing the piston to the stop actuating the valve.

The mining nozzle is located adjacent to and disposed 90 degrees from the slurry entrance to attack the ore matrix at the base of the deposit to induce subsidence of the ore into the mining jet; the vertical hoist being employed to raise the mining nozzle and break-up the ore matrix as needed. The ability to attack the ore matrix at its base is of particular importance where subsidence of the overburden is a problem. The close proximity of the mining jet with respect to the drill bit is of particular benefit where the ore deposit is over an acquifer to avoid penetrating into it.

The fluid supply conduit to the drilling and mining head contains a flow measuring element interconnected with a flow control valve to control the supply of fluid to the annular space between the conduits of the tool string, the center conduit of the tool string is connected through a swivel to discharge ore or drill cuttings through a discharge pipe containing a flow measuring element, a density measuring element to ascertain production rates, a slurry pump when appropriate and a slurry discharge control valve to control the volume of effluent from the tool. When the tool is used to drill a borehole from the surface without water entering the borehole in large quantity, controlling the volume of discharge from the tool also controls the height of the fluid in the borehole or cavity with the eductor nozzle being presized large enough to effect the draw-down in the borehole.

An orifice could be installed in the discharge conduit from the tool string to restrict the volume of effluent from the tool, however, a control valve has the benefit of modulating the discharge to provide a finer degree of control.

When mining with the ore cavity flooded, controlling the liquid level in the borehole at or near the surface permits the slurry eductor to be located only sufficiently below this level to prevent cavitation in this second or slurry eductor jet. The hydraulic head in the borehole above the slurry eductor raises the slurry to the eductor nozzle. Positioning the slurry eductor in this manner permits the recovery of ore from deeper strata than heretofore possible with existing tools. An important feature of this invention is that the slurry eductor is located sufficiently below the fluid level in the borehole to prevent cavitation of the eductor jet and that the hydraulic head above the eductor nozzle is maintained, without the influx of ground water, by throttling the flow control valve in the discharge piping.

In the drilling mode, the drilling fluid is pumped through the supply conduit (200 to 350 psig) to the connection on the drilling and mining head that connects to the annular space between the conduits and is directed down the drill string through the normally open valve controlling the flow of fluid to the drill bit, the fluid is also directed through the normally open valve controlling the flow of fluid to the eductor at the slurry inlet of the tool and to the second eductor pump nozzle to pump the drill cuttings to the surface by reverse circulation. The drilling and mining fluid is usually water. Sections of the drill pipe are added to the drill string intermittently during the drilling operation until the ore zone is reached.

When the mining tool has been drilled down to and is properly positioned with respect to the ore deposit, the volume and pressure of the fluid pumped into the annular space between the conduits is increased. The increase in pressure to a range of 600 to 1200 p.s.i.g. actuates the down-hole valve actuators to stop the flow of fluid to the drill bit, closes the valve controlling the fluid flow to the eductor nozzle at the slurry inlet, opens the mining nozzle control valve to reduce the ore to a slurry and increases the fluid flow to the slurry eductor nozzle located intermediate of the lower eductor section and the discharge of the tool to pump the ore slurry to the surface. The flow meter and control valve in the discharge line monitors the fluid flowing from the tool, the supply piping contains a flow meter and a flow control valve to monitor the fluid flow to the tool string, well-known instrumentation is used to control the operation of the tool, i.e., equalize the flow in each line, compensate for the influx of ground water or control the liquid level in the borehole. During mining the tool string is rotated by the power swivel continuously, usually less than one-half revolution per minute, or intermittently for increased seal life.

Another embodiment provides the apparatus with two mining nozzles and a method of operating the same to slurry the ore at two different levels or seperate ore strata with self-activating controls actuated by the pressure of the fluid pumped into the tool string. An additional mining nozzle section is provided which can be assembled into the tool string to attack the ore matrix at another elevation or at a seperate ore deposit. Provision is also made to operate these nozzles independantly or simultaneously. When both mining nozzles are used simultaneously the valves and the valve actuators are made structurally the same and the valves are opened by the force of the water pressure during mining conducted from the annular space between the conduits.

A third embodiment provides for operation of two mining nozzles independantly with the lower mining nozzle supply conduit being fitted with two control valves and the upper nozzle with one control valve; the lower nozzle conduit having one normally closed and one normally open control valve while the upper fluid supply line has one normally closed valve, flow to each mining nozzle being closed during the drilling mode. When mining fluid pressure at 800 p.s.i.g. is applied to the system the lower normally closed valve is opened by the fluid pressure causing the mining fluid to jet into the ore matrix and slurrify the ore. When it is desired to have the upper nozzle attack the ore matrix with the lower valve closed, a higher mining pressure (950 p.s.i.g.) is used; the mining nozzle control piping to each mining nozzle control valve contains a pressure relief valve which opens at 900 p.s.i.g. and directs the discharge pressure from the relief valves to the valve actuators to change the normal position of the valves-closing the lower fluid supply line and opening the valve on the upper mining nozzle fluid supply line. When it is desired to attack the upper matrix first, the higher supply pressure is used initially or the valves and valve actuators in the conduits to the mining nozzles can be reversed. Each of the control conduits contains a small bleed orifice after the relief valve to vent a small percentage of the fluid from the relief valves to restore the system to its normal position when the high mining pressure is no longer used.

A fourth embodiment is the provision of having the upper slurry jet nozzle closed during drilling by installing a normally closed valve in the jet fluid supply line which is opened by the mining system pressure.

A fifth embodiment provides for the installation of a pressure reducing orifice or device in the fluid supply line to the upper slurry eductor nozzle to reduce the pressure and the nozzle velocity to prevent cavitation of this eductor.

In the sixth embodiment of this invention, the lower eductor nozzle fluid supply line is open during the drilling and mining cycles.

In a seventh embodiment of this invention two eductor pumps are used to raise the slurry and a flow restricting orifice is installed in the supply line to the lower eductor jet nozzle to control its velocity through the nozzle during mining. In hydraulic borehole mining it is desirable to be able to control the draw-down or level of mining water in the mining cavity so that the mining jet could be made more effective when jetting in air. When this mode of operation is employed while drilling in a pond or other body of water the conductor pipe 12*a* is extended above the water level. The lower eductor nozzle is also referred to as the first eductor and it is located at the slurry entrance to the discharge conduit; the slurry eductor located above the lower eductor is also referred to as the second eductor. Many ore deposits in consolidated form require high velocities in the mining jet to slurry the ore; these velocities would cause cavitation in an eductor jet placed at the slurry entrance using system pressure with only a small suction head at the slurry entrance to the tool. The flow restricting orifice in the conduit to the lower eductor nozzle reduces the pressure and the velocity of the jet sufficiently to prevent cavitation of the eductor. The lower or first eductor then provides sufficient hydraulic head to raise the slurry to the second or slurry eductor which receives higher pressure or system pressure to raise the slurry to the surface.

BRIEF DESCRIPTION OF THE DRAWINGS

FIG. 5 is a sectional view in elevation of the slurry eductor section with the feed piping to the eductor nozzle not sectionalized illustrating the arrangement of the eductor nozzle, mixing throat, diffuser section and the by-pass piping for supplying fluid to the lower tool section. The control valve 70 and valve operator 71 of the fourth embodiment is shown in solid lines. The flow restricting orifice 79 of the fifth embodiment is also shown in solid lines.

FIG. 5A is a plan view of this section showing the orientation of the control valve, valve operator and by-pass piping.

FIG. 7A is a plan view and

FIG. 7A is a partial sectional elevation of an additional mining nozzle section disclosed in the second embodiment of this invention.

FIG. 8 is a diagrammatic arrangement of the control piping for operating two mining nozzles independantly.

DESCRIPTION OF THE PREFERRED EMBODIMENT

Figure 1:
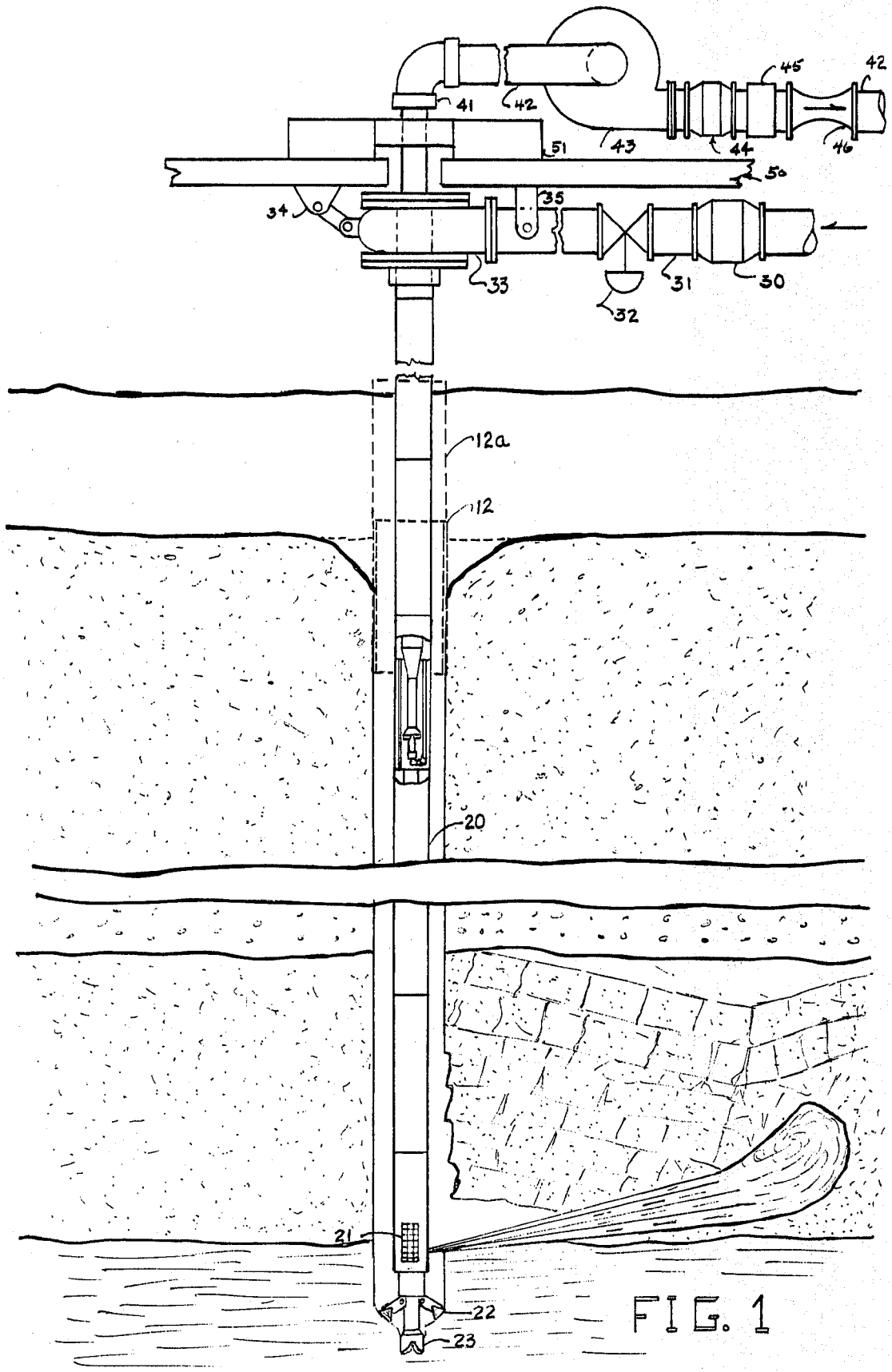
FIG. 1 is a view in elevation, partly broken away and partly in section, illustrating the operative components of the drilling and mining apparatus.

The process of and apparatus for mining a subterranean ore deposit through a well bore is illustrated in FIG. 1. The apparatus is supported from a vertically movable hoist or drilling derrick mounted on a mobile vehicle or a barge. The support 50 for the power swivel 51 is from the conventional components of a drilling rig; the power swivel drives the drill string 20 in rotary motion during both the drilling and mining operations. During mining the drill string 20 can be driven continuously or intermittently. The drill string 20 is a dual-conduit pipe string with a drill bit and underreamer as its drilling head with the drill cuttings and ore slurry returning to the surface via the inner conduit 24 FIG. 2 as in reverse circulation while the fluid supply for the tool string 20 is through the annular space between the conduits; the eductor sections and the mining section being exceptions. The sections of the tool string are assembled during drilling with screwed joints by conventional components of the drilling rig until the mining tool is properly positioned within the ore bed.

Figures 2, 2A:
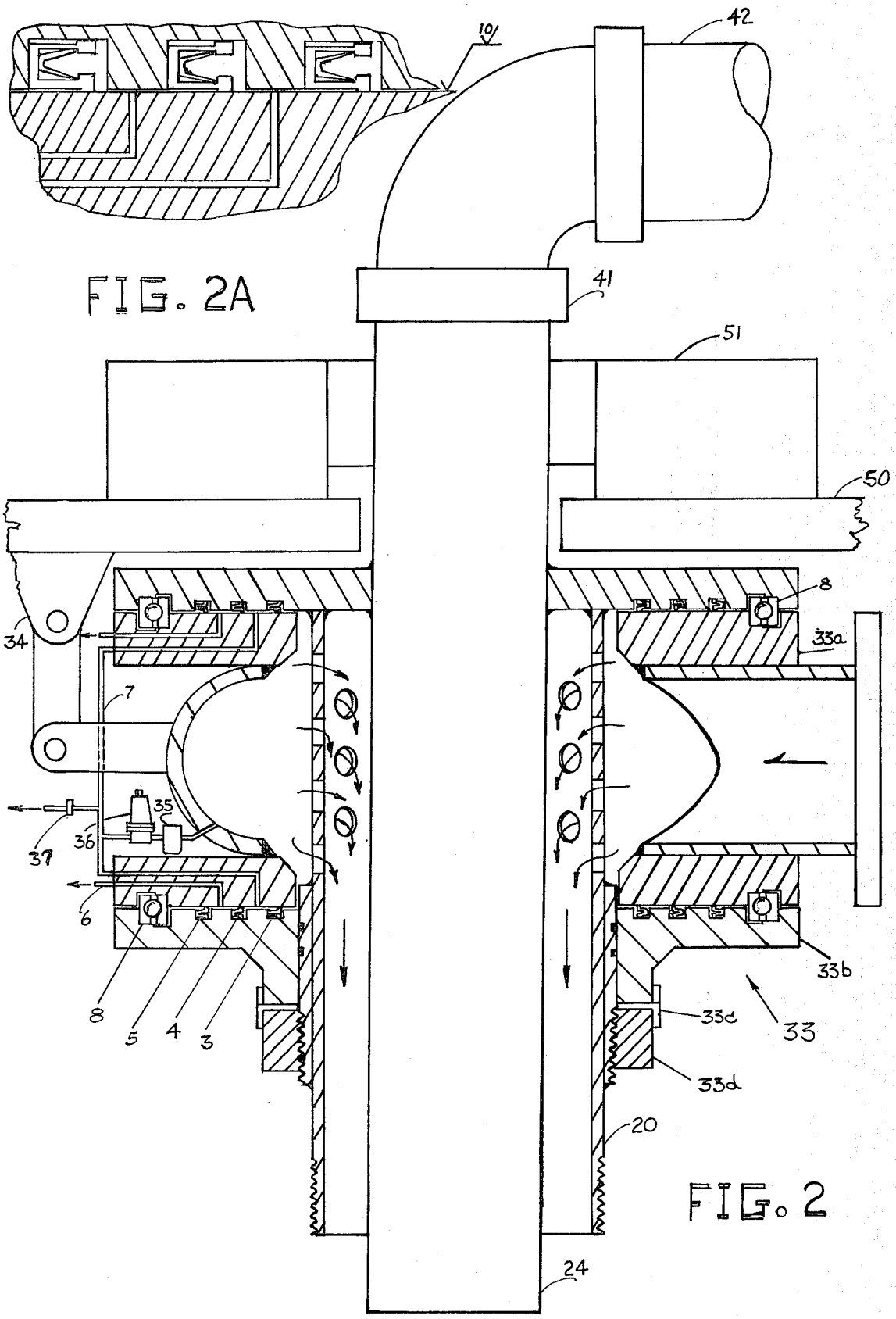
FIG. 2 is a vertical section of a combination drilling and mining head illustrating the radial orientation of the seals and the bearings together with the fluid flow pattern to the tool.
FIG. 2A is an enlarged view of the seal structure.

The power swivel drives the outermost casing of the tool string 20 through a drilling and mining head 33 having a stationary fluid supply manifold 33*a* retained from rotating by the restraining arms 34. Thrust bearings 8 position the stationary manifold with respect to the rotating flanges attached to the drill string. Close dimensional tolerances are extremely important in high pressure seals. Seals to withstand 1000 p.s.i.g. pressure must have the housings and mating surfaces machined to a max. clearance of approx. 0.006". If the mating surfaces were about the axis of the drill string the bearing run-out and out-of-roundness would have to be held within this tolerance. In addition, any wear would require that the surfaces be built-up to be within the dimensional allowance. Mounting the mating surfaces radially with respect to the axis of the drill string permits the bearings 8 to be preloaded to remove the bearing play and with shimming, if necessary, the clearance can be adjusted by the take-up nut 33*d* securing the lower flange 33*b*. Although flurocarbon lip seals are preferred for this service, it will be recognized that other seals can be used. During mining when high pressures are used the rotation of the tool string is usually below one-half revolution per minute; intermittent rotation of the drill string is also possible to extend seal life. Although a single seal could be used, two seals 3,4 are preferred with the water pressure from the stationary manifold 33*a* at 800 psig or above directed through the filter 35 and a pressure regulator 36 to reduce the pressure to about 400 psig and piped 7 into the annulus between the seals to reduce the pressure drop across the first seal 3. In the conduit 7 connecting the reduced pressure seal water with the annulus between the seals a bleed orifice 37 is inserted to reduce the pressure between the seals when the manifold pressure drops. An additional seal 5 is installed to prevent water entering the bearing 8. A bleed line 6 is installed before the seal 5 to draw-off any water that might pass through the seals. FIG. 2 indicates a section of the point-contact bearings indicating the method of handling bearing loads. The lower flange 33*b* is keyed below the seals to the drill string 20 and rotates with it being retained with a screwed locknut 33*d* to preload the bearings to maintain rolling contact and secured with a keyed lock washer 33*c* to prevent rotation of the locknut 33*d*.

Figure 3:
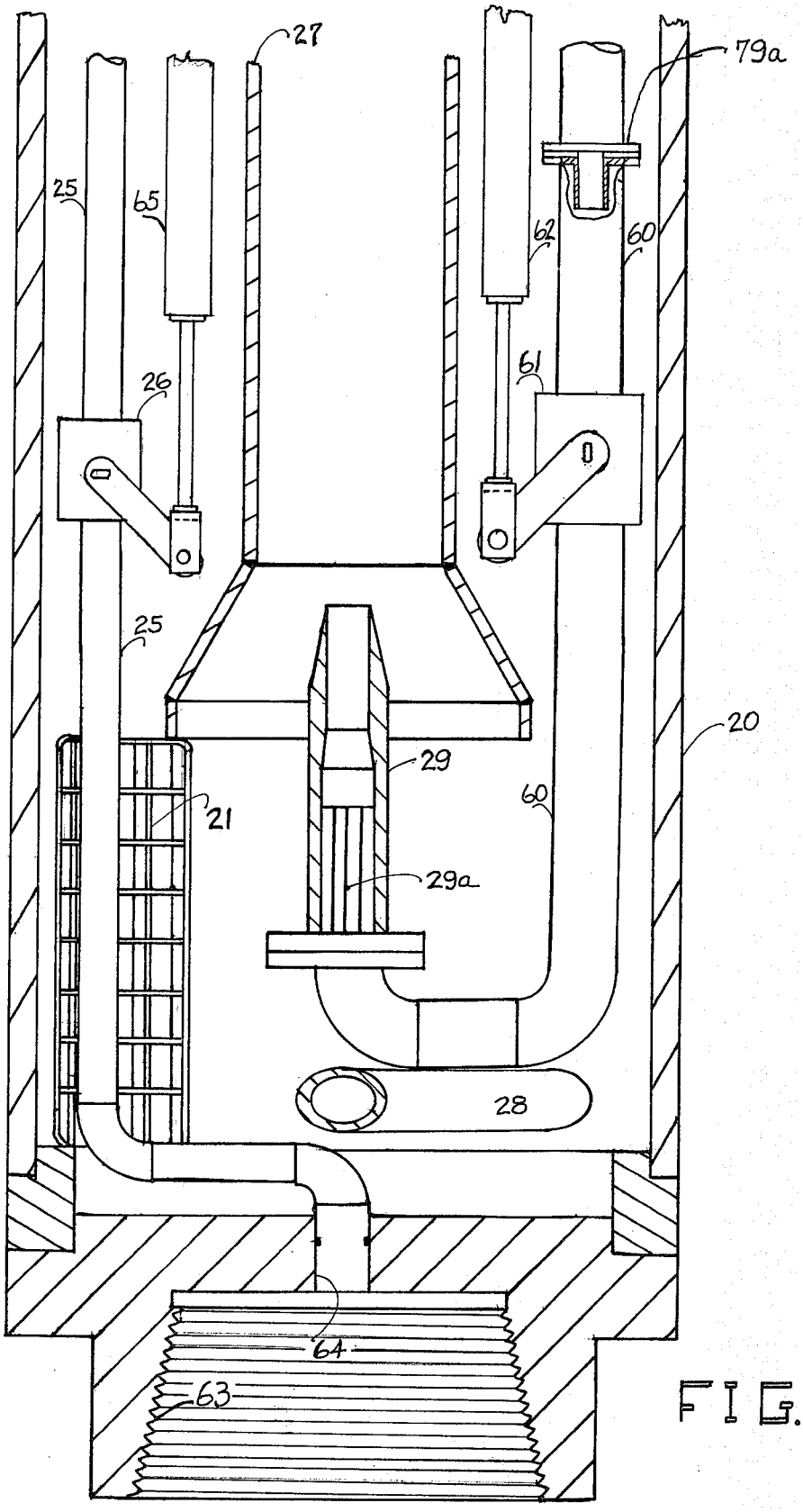
FIG. 3 is a sectional view in elevation of the lower tool section with the piping not sectionalized illustrating the arrangement of the mining nozzle, slurry entrance, lower mixing throat, lower eductor nozzle and the control valves with valve actuators.
Figure 4A:
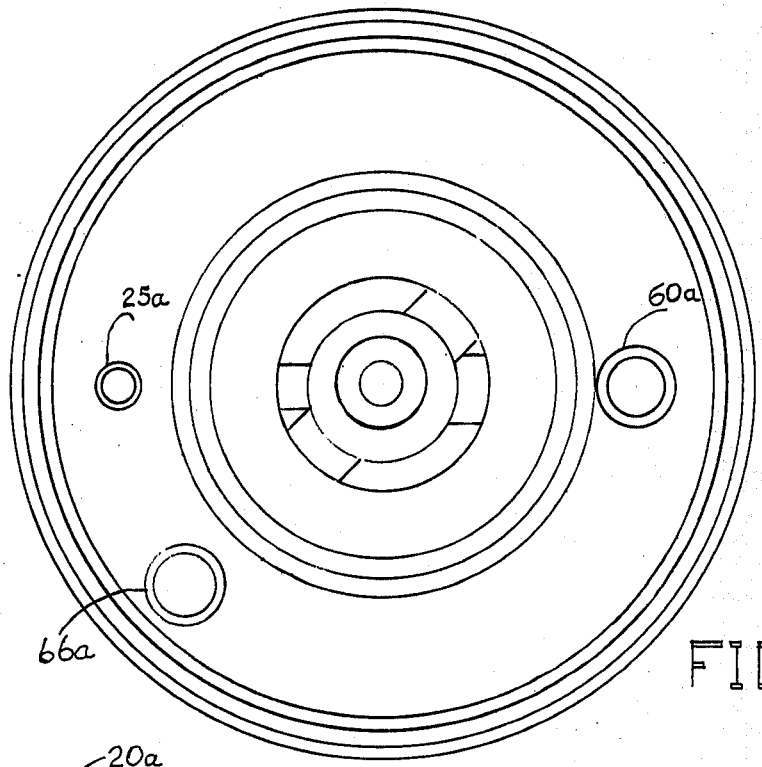
FIG. 4A is a plan view.
Figure 4:
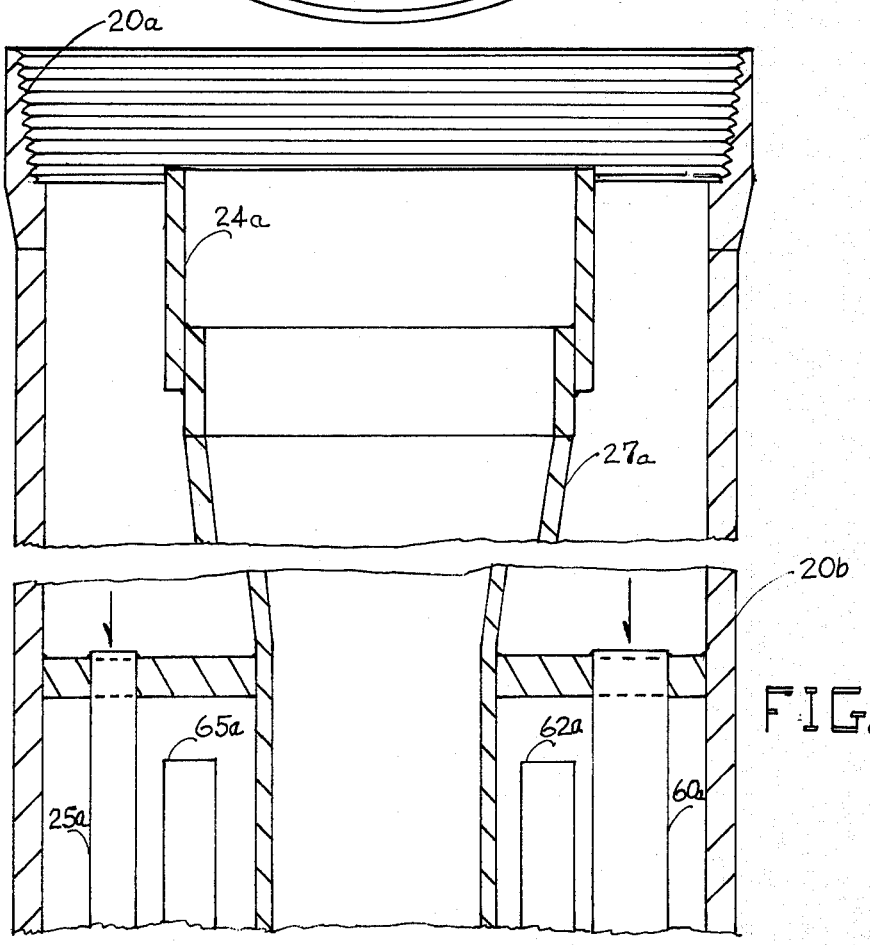
FIG. 4 is a sectional view in elevation of the upper portion of the tool section depicted in FIG. 3 illustrating the orientation of the tool control valves and the feed piping to the valves.

The lower tool section FIG. 3 has a conventional rotary bit and underreamer secured to the threaded section 63 for drilling a well or borehole from the surface into the mineralized strata. Drilling water (200 to 350 p.s.i.g.) is directed to the drill bit through the normally open valve 26 which is closed during mining by the valve actuator 65. Drill cuttings and or ore slurry enter the tool through the grill 21 and are pumped through the mixing throat of the eductor by the velocity of the water from the eductor nozzle 29. Fluid flow from the eductor nozzle 29 is controlled by the normally open valve 61 through the conduit 60. The valve actuator 62 closes the valve 61 when the mining pressures are imposed on the tool string supply piping. Mining fluid, usually water, is controlled by normally closed valve which is opened by a valve actuator similar to valve FIG. 3 when mining system pressures are pumped into the tool string. FIG. 4 shows the orientation of the piping to the control valves in the plan view of this lower tool section. The mining nozzle 28 FIG. 3 is similar to the eductor nozzle in that it has straightening vanes similiar to 29*a*. In the elevation of FIG. 4 is shown the threaded connection 20*a* between the tool sections and the sliding fit adaptor 24*a* at the top of the diffuser section 27*a*.

FIG. 5A is a plan view and FIG. 5A is a partly sectional elevation of the slurry eductor section 82 which is installed in the tool string sufficiently below the liquid level in the borehole to prevent cavitation in the eductor of this section. System pressure is pumped through the conduit 72 to the eductor nozzle 73 which pumps the slurry through the mixing throat 74 and diffuser 75. Normally there is no valve in the fluid supply line 72 to the nozzle 73, the nozzle being open during the drilling and mining cycles. A fourth embodiment of this invention provides facilities for stopping fluid flow to the eductor 73 during drilling by the installation of a normally closed control valve 70 and valve actuator 71 in the piping 72; these facilities are shown in FIG. 5. In a fifth embodiment of this invention a pressure reducing device 79 is installed in the line 72 to reduce the velocity in the eductor jet 73; this facility is shown in in FIG. 5. By-pass lines 76,77,78 are shown in the plan view; they supply fluid at system pressure to the lower tool sections.

Figure 6:
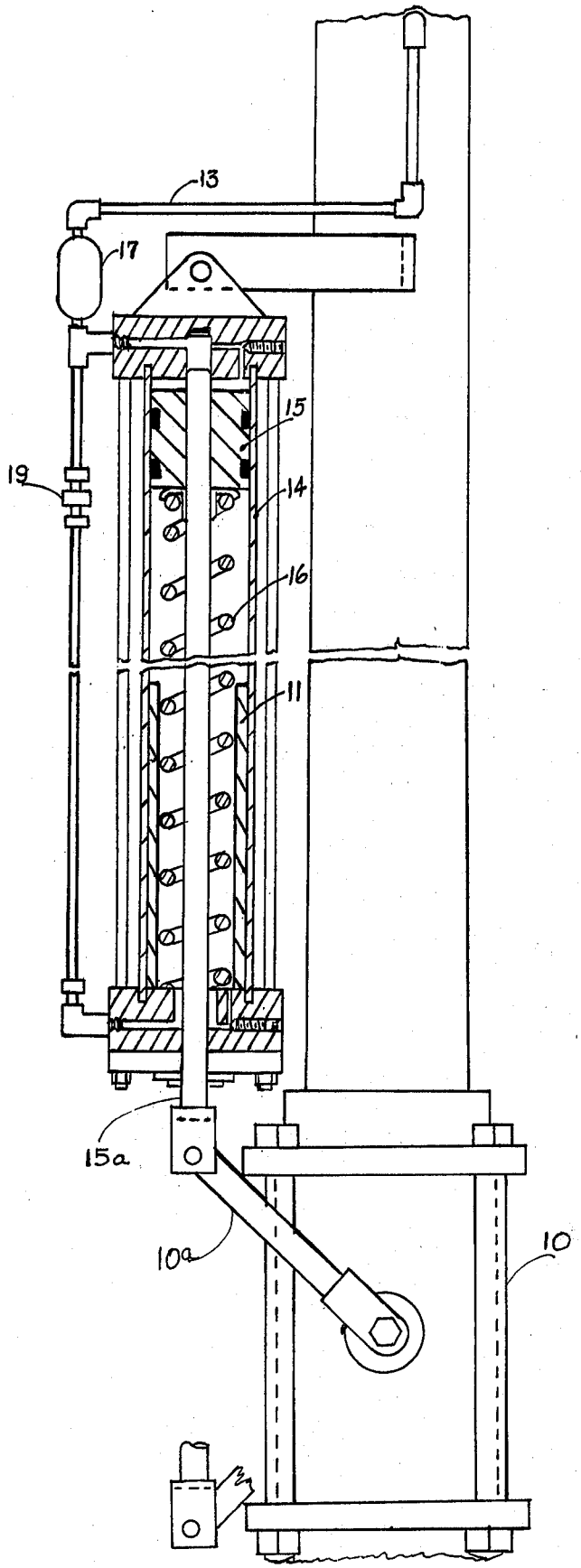
FIG. 6 is a view in elevation of a typical control valve with a sectional view of the valve actuator to illustrate the location of the resilient means within the cylinder, the piston stop and the piping arrangement with the bleed orifice between the cylinder ends and the fluid supply line to the actuator.

FIG. 6 is a typical arrangement of the valve actuators used in this invention. System pumping pressure from the annulus between the conduits of the tool string is directed into a conduit 13 connected to both ends of the cylinder actuator 14 applying equal fluid pressure to both sides of the piston 15. A filter 17 is installed in the conduit 13 to provide clean fluid (water) entering the actuator. The valve control handle 10*a* is connected to the valve stem in the normal operating position of the valve 10 when the piston 15 is held in the retracted or normal position within the cylinder by the spring 16 when pressure is not imposed on either side of the piston 15. During drilling when the pressure is usually 200 to 350 p.s.i.g. the piston 15 is held in the retracted position within the cylinder 14 by the spring 16 which overcomes the force tending to drive the piston toward the rod end of the cylinder. When high mining pressure—800 p.s.i.g. and above—is imposed on both sides of the valve actuator cylinder 14 the piston 15 is urged or forced toward the stop 11 by the increased force driving the piston 15 toward the rod end of the cylinder by the differential area of pressure across the piston 15; the differential area being caused by the reduction in area on the rod end 15*a* due to the area of the rod 15*a* which has only the pressure in the inner conduit acting on the piston rod. The conduit between the cylinder ends contains a metering orifice 19 to control the rate of movement of the piston to slowly actuate the valve and reduce water hammer in the system. An important feature of these self-actuating controls is that only the pressure from within the annular space between the conduits is applied to actuate the valves.

Water is pumped in FIG. 1 into the tool string fluid supply line 31 which is connected to the stationary element 33*a* of the drilling and mining head 33; this head is restrained from rotating by the brackets 34,35 attached to the hoist and tool support 50. The fluid supply line 31 contains a conventional flow measuring element 30 interconnected with a flow control valve 32 to control the supply of fluid entering and directed down the annular space between the conduits of the tool string 20. The drill cuttings and ore slurry are discharged from the center conduit through a swivel 41 to the discharge line 42. A transfer pump 43 is installed to increase the discharge head of the effluent from the tool and to overcome the pressure drop across the discharge control valve 46. The discharge line 42 also contains a flow measuring element 44, a density measuring element 45 and a slurry discharge control valve 46 to control the volume of effluent from the tool; the density measuring element being used only to determine ore recovery rates. Well-known instrumentation is used to equalize the flow in the supply and discharge lines or compensate for the influx of water to the borehole or cavity.

In the preferred embodiment of this invention the drilling and mining operations are carried out with the cavity flooded and water in the wellbore. Prior to drilling, a large conductor pipe 12 is driven into the overburden to prevent the soil about the wellbore from entering the borehole during drilling. Conventional well drilling equipment is used to assemble the drill string 20 section-by-section as drilling progresses through the conductor pipe 12 to the mineralized zone. When drilling from a barge it is unnecessary to have the conductor pipe extend above the water level because the flow into and out of the borehole is controlled by the control valves in the supply and the discharge lines of the tool. A biodegradeable cardboard or sonotube can also be used and the tube discarded; the barge being moved over the abandoned wellbore. An important feature of this invention is that the drilling and mining fluids plus the drill cuttings and ore slurry are conveyed within the tool string 20 so that the tool acts as its own casing during both the drilling and mining operations. During many applications the use of the conductor pipe can be eliminated or substantially reduced in size. After drilling to the ore deposit the tool is operated in its mining mode to recover the ore slurry. Subsequently the tool is removed from the borehole and disassembled section-by-section by conventional well drilling equipment on the drilling platform.

The method and apparatus of the present invention is primarily intended for use in mining granular phosphates similiar to those found in Florida at depths of 100 to 900 ft. and sedimentary uranium deposits as found in Canada at depths of 800 ft., however, it will be understood that the apparatus can be used at different depths and on other ores capable of being slurrified and pumped to the surface. Standard tool strings can be fabricated in sizes of 12", 16" and 20" pipe size but are not restricted to these dimensions. The size of the ore particle capable of being brought to the surface is restricted to the size of the openings in the grating of the slurry entrance. The size of the openings in the slurry entrance grating is determined by the size of material capable of passing through the eductors, the slurry pump and the slurry control valves of each particular line size. Normally two inch to three inch particles are handled with facility.

DUAL MINING NOZZLES OPERATING SIMULTANEOUSLY

In hydraulic borehole mining it is frequently desirable to mine more than one ore strata while the tool remains in the borehole. A second embodiment of this invention provides a seperate mining nozzle section 84 shown in FIG. 7 that is assembled into the tool string to line-up with the ore matrix at another elevation or a seperate ore strata. The mining tool section located at the base of an ore strata is shown in FIG. 7 and has been previously described. In this special section 84 the slurry return line 24*a* and 24*b* is offset to accommodate the installation of the mining nozzle control valve 83 and the valve actuator 36. The slurry return line 24*a* and 24*b* is separated to extend the mining jet nozzle athwart the vertical axis of the tool string. The slurry returning to the surface is permitted to pass about the mining nozzle because of the increased slurry flow space in the area about the nozzle 82. The control valve 83 is mounted in the conduit 81 to control the flow of mining fluid to the mining nozzle 82. The mining nozzle 82 has straightening vanes 82*a*. The mining valve actuator 86 is subject externally to the pressures within the slurry discharge line and internally to the pressures within the annular space between the conduits. The control tubing to the actuator 86 can be taken from the upstream side of the valve 83 on the tubing 81 or from a nipple 85 welded to and extending through the diaphragm 97. Two fluid conduits 95 and 96 extend between the diaphragm 97 and 98 to convey fluid at system pressure to the sections of tool string 20 down the borehole. While two conduits are shown it will be understood that the number of conduit by-passes to the lower tool section is not limited to this number.

FIG. 7A is a plan view of this section showing the valve and piping orientation. When it is desired to have both mining nozzles operate simultaneously the control conduits to the valve actuators and the normal position of the valves (closed) are as shown in FIG. 8 arrangement 92 and further detailed as in FIG. 6. The valves are opened by the mining pressure and the slurry is raised to the surface by the slurry eductor.

SELECTIVE CONTROL OF DUAL MINING NOZZLES

A third embodiment of this invention provides for operating mining nozzles at different elevations seperately. When two mining nozzles are to be operated seperately the lower mining nozzle feed pipe 66*a* FIG. 8 is fitted with two control valves 66 and 93 and the upper nozzle FIG. 8A (control system 90) with one control valve 83 normally closed; the lower mining nozzle piping 66*a* having one normally closed valve 66 (control system 92) and one normally open control valve 93 (control system 91), flow to each mining nozzle being closed during the drilling mode. The upper control valve 83 FIG. 8A and the lower control valve 93 FIG. 8 being actuated by the pressure from the relief valves 87 and 87*a*. When mining system pressure at 800 p.s.i.g. for selective control of the mining nozzles is applied to the system the lower normally closed valve is opened by the fluid pressure causing the mining fluid to jet into and slurry the ore matrix. When it is desired to have the upper nozzle attack the ore matrix with the lower valve closed, a higher mining pressure of 950 p.s.i.g. is used. The mining nozzle control piping 99 and 99*a* to each mining nozzle control valve operator 86, 86*a* contains a pressure relief valve 87,87*a* which opens at 875 p.s.i.g. and directs the fluid from the relief valves to the valve actuators 86,86*a* changing the normal position of the valves; closing the lower feed line control 93 and opening the upper mining nozzle control valve 83. Each of the valve actuator feed lines from the relief valves contains a small bleed orifice 89, 89*a* after the relief valve to vent fluid pressure from the system through the filters 94,94*a* to restore the valves to their normal position after the high pressure of the system is no longer used.

It will be noted that the valve lever arms have a different slot orientation at the valve stem for each normal position of the valve; for a normally open valve it is as shown in FIG. 8 100*a* while the lever arm for a normally closed valve is shown as 100*b*.

DESCRIPTION OF SPECIFIC EMBODIMENTS

A fourth embodiment provides for installing a normally closed flow control valve 70 in dotted lines FIG. 5 in the piping 72 to the upper eductor 73 to close off the flow of water to the slurry eductor during the drilling mode.

A fifth embodiment provides for the installation of a flow restricting orifice 79 in the fluid supply line 72 to the upper eductor nozzle 73 FIG. 5 to reduce the velocity of the fluid to the nozzle to prevent cavitation of the eductor.

In the sixth embodiment of this invention the fluid supply piping 60 FIG. 3 to the nozzle 29 is open during the drilling and the mining modes.

A seventh embodiment of this invention is provided in which two eductor pumps in the discharge conduit are employed wherein the fluid supply conduit to the lower eductor nozzle contains a flow restricting orifice 79*a* in solid lines FIG. 3 to reduce the velocity in the lower eductor jet sufficiently to prevent cavitation in this eductor while raising the slurry to a second eductor employing higher pressure or system supply pressure to raise the slurry to the surface.

While the embodiments of this invention have been described herein, it will be understood that this invention is not limited to the embodiments shown, but that variations and changes in design thereof may be made without departing from what is regarded to be the subject matter of this invention.

We claim:

1. A method of hydraulic borehole mining by drilling into a subterranean ore deposit, reducing the ore to a slurry and pumping the ore to the surface with an apparatus which includes a mobile platform having a drilling mast with a vertical hoist for handling the drill string, power slips and wrenching means for assembling the drill string sections intermittently during drilling until the ore strata is reached, a swivel head on the uppermost section of the drill string with the fluid supply connection entering the annular space between the conduits and a slurry discharge connection connected through a swivel to the inner conduit, a dual conduit tool string having a drill bit as its drilling head, drilling fluid controlled by a valve that is normally open during drilling and closed during mining, two hydraulic eductor pumps within the discharge conduit, the first or lower eductor is located at the suction entrance at the base of the tool and is controlled by a valve that is normally open during drilling and closed during mining, the second or slurry eductor is located intermediate of the mining section and below the fluid level in the borehole with fluid jetting from the eductor nozzle during the drilling and mining mode to pump drill cuttings and/or slurry to the surface, a mining nozzle adjacent to the slurry entrance to the tool to erode the ore matrix to form an ore-bearing slurry and controlled by a valve that is normally closed in the drilling mode and open during the mining mode, a flow measuring element and a flow control valve in the fluid supply pipe to the drill string, a flow measuring element and a flow control valve in the discharge conduit from the mining tool; the method comprising the steps of drilling a borehole from the surface to the ore deposit while pumping drilling fluid at drilling system capacity and pressure into the supply conduit and directing the fluid down the annulus between the conduits through a normally open valve to the drill bit and through a normally open control valve supplying fluid to the eductor at the suction entrance and also through the second or slurry eductor nozzle which is open during drilling and mining to pump the drill cuttings to the surface, increasing the capacity and pressure of the supply fluid to mining system conditions, pumping the mining fluid down the annulus between the conduits with the increased fluid pressure actuating the down-hole control valve actuators to convert the tool from the drilling to the mining mode by closing the valve and stopping the flow of fluid to the drill bit and to the lower eductor nozzle while opening the mining nozzle control valve and directing mining fluid through the mining nozzle to reduce the ore to a slurry, rotating the tool string continuously or intermittently during mining, pumping the slurry to the surface by the slurry eductor located within the inner conduit intermediate of the mining section and the discharge of the tool, throttling the flow of fluid from the tool string by the flow control valve in the discharge piping to maintain the fluid level in the borehole sufficient to prevent cavitation in the slurry eductor pump.

2. A method according to claim 1 wherein the flow control valve in the discharge piping is used to control the volume of effluent from the tool string when water from an acquifer, pond, or an already mined-out area is entering the borehole or cavity.

3. A method according to claim 1 wherein the fluid flow passage to the lower eductor nozzle is open during the drilling and mining cycles.

4. A method according to claim 1 wherein a slurry eductor flow control valve and valve operator are installed in the conduit to the upper slurry eductor nozzle which is normally closed during drilling and open during mining.

5. A method according to claims 1 or 4 wherein reducing the mining pressure to drilling pressure causes the resilient force of the spring in the valve actuators to close the mining nozzle, open the valve controlling the flow of fluid to the drill bit and changes the eductor nozzle control valves to their normal position.

6. A method according to claim 1 wherein said drilling pressure is from 200 to 350 p.s.i.g. and said mining pressure is approx. 600 p.s.i.g. or higher.

7. A method according to claim 1 wherein an underreamer is used in conjunction with the drill bit as the drilling head.

8. A method of pumping drill cuttings or ore slurry from a deep well or cavity with hydraulic eductor pumps with the slurry discharge conduit having a first eductor section with a pressure reducing device in the supply conduit to the eductor nozzle and with another eductor pump or pumps located within the discharge conduit and above the first eductor employing higher pressure or system pressure to the eductor nozzle comprising the steps of: pumping fluid at recovery system pressure and capacity into the tool and directing a portion of the fluid through a pressure reducing device in the supply piping to the first eductor nozzle to control the fluid velocity at the nozzle, raising the slurry to the next eductor above the first and providing sufficient hydraulic head to prevent cavitation in the later eductor nozzle, directing fluid at recovery system pressure or below through the later eductor to pump the ore slurry to a higher eductor or to the surface.

9. A method according to claim 8 wherein the first eductor nozzle supply conduit is without a pressure reducing device before the eductor nozzle.

10. A method according to claim 8 wherein the second eductor nozzle supply conduit contains a pressure reducing device to control the velocity of fluid in the eductor nozzle.

11. A method according to claims 8, 9 or 10 wherein a slurry discharge control valve is installed in the discharge piping from the tool to throttle the discharge flow from the tool.

12. A method of recovering ore slurry or hydraulically conveyed material from a deep well or cavity through a discharge conduit of a mining tool having a slurry eductor pump assembled into the conduit and located intermediate of the mining nozzle section of the tool and a position below the fluid level outside the tool string and with a discharge control valve or orifice in the discharge piping from the tool comprising the steps of pumping fluid into the tool and through the slurry eductor nozzle of the slurry eductor pump to pump the slurry through the discharge conduit and piping, throttling the discharge flow by an orifice or the control valve in the discharge piping to limit the volume of effluent from the tool or to maintain a hydraulic head above the slurry eductor pump outside the tool sufficient to operate or prevent cavitation in the eductor.

13. A method according to claim 12. wherein a flow control valve is installed in the fluid supply conduit to the slurry eductor nozzle with a control valve actuator controlled by the system pressure in the fluid supply conduit which selectively closes the valve during drilling and opens the valve during mining.

14. A method according to claims 12 or 13 wherein a pressure reducing device or orifice is installed in the conduit to the slurry eductor nozzle to control the fluid velocity to the eductor nozzle.

15. A method of controlling the flow of effluent from a borehole or slurry mining tool having an eductor pump consisting of a high velocity jet, mixing throat and diffuser section in the discharge conduit to pump an ore slurry of varying specific gravity comprising:

(a) pumping water into a supply conduit to the tool containing a flow measuring element and a flow control valve which are monitored by a flow control instrument;

(b) directing the effluent from the slurry mining tool through a discharge pipe containing a flow measuring element, a slurry flow control valve and monitored by a flow control instrument;

(c) controlling the flow in each conduit to equalize the flows;

(d) adjusting the instruments to compensate for the influx of water or varied to control the draw-down in the borehole when water is not flooding the cavity.

16. A method according to claim 15 wherein the discharge piping above ground contains a slurry pump before the slurry control valve.

17. A method of borehole slurry mining ore from two separate strata at different elevations without removing the tool from the borehole with an apparatus which includes a separate mining nozzle section assembled into the tool string at the desired elevation and having a normally closed valve in the supply conduit to the mining nozzle with a cylinder-piston valve actuator controlled by the pressure from a pressure relief valve which opens at 100 p.s.i.g. above normal mining pressure and is connected to and receives pressure from the fluid supply conduit of the tool string and having a small vent orifice in the conduit after the relief valve for restoring the normal position of the valve after the relief valve closes, in the lower mining nozzle section at the base of the tool two control valves, one normally open and one normally closed, are installed in the fluid supply conduit to the mining nozzle; the first control valve is normally closed and the cylinder-piston actuator is actuated by the fluid supply pressure to open the valve during the mining mode, the second control valve actuation is similiar to the valve actuator used in the upper mining nozzle section except the valve is normally open and is closed by the fluid pressure from a relief valve which opens at 100 p.s.i.g. above normal mining pressure; the method comprising the steps of pumping drilling fluid into the tool string at drilling system pressure and capacity and drilling unitl the ore strata are reached, increasing the mining system pressure by an additional 100 p.s.i.g. or higher to open the eductor nozzle control valve to raise the slurry to the surface and also actuating the upper mining nozzle valve controller to open the valve and jet mining fluid into the upper ore strata to reduce it to a slurry while the second control valve in the lower mining tool is closed by the pressure from the lower relief valve, reducing the mining system pressure to normal pressure thereby closing the upper mining nozzle control valve and opening the second control valve in the lower mining section to permit the mining fluid to slurry the lower ore strata.

18. A method of borehole slurry mining ore from two separate strata at different elevations without removing the tool from the borehole by assembling into the tool string at the desired elevation a separate mining nozzle section with a mining nozzle control valve actuator controlled by the supply fluid pressure and being normally closed during drilling and open during mining and a similiar mining nozzle control at the slurry inlet to the tool; the method comprising the steps of pumping drilling fluid into the tool string at drilling system pressure and capacity and drilling down until the ore strata is reached, increasing the pressure of the fluid pumped into the tool to mining system pressure to actuate the mining nozzle control valves to open the valves and jet mining fluid at both elevations into the ore matrix to reduce it to a slurry and opening the eductor nozzle to pump the ore slurry to the surface.

19. A method according to claim 18 wherein the drilling system pressure is from 200 to 350 psig and the mining system pressure is 600 psig or higher.

20. An apparatus for actuating down-hole flow control valves in a borehole mining tool that is responsive to changes in pressure of a fluid directed into the tool string, which comprises:

(a) A control or lever arm attached to the valve stem of a flow control valve in its normal position;

(b) A hydraulic power cylinder with a piston within the cylinder and a piston rod attached thereto and extending through the cylinder and pivotally attached to the flow control arm or lever while the head end of the cylinder is pivotally attached to a structural support to permit arcuate movement of the control valve lever;

(c) A spring within the cylinder at the rod end capable of holding the piston at the head end when subjecting the head end of the cylinder to drilling pressure;

(d) A stop within the rod end of the cylinder positioned to allow 90 degrees more or less of travel of the control arm on the valve;

(e) Piping connecting the fluid supply conduit of the mining tool to the head end of the cylinder and an outlet from the rod end of the cylinder to the pressures within the discharge conduit of the tool;

(f) means for increasing the hydraulic pressure of the fluid directed into the tool string which is applied to the head end of the cylinder forcing the piston to travel toward the rod end of the cylinder actuating the control valve.

21. An apparatus for actuating down-hole flow control valves in a borehole mining tool by a hydraulic power cylinder responsive to changes in pressure of a fluid directed into the tool string, which comprises:

(a) a control or lever arm attached to the valve stem of a flow control valve in its normal position;

(b) a hydraulic power cylinder with a piston within the cylinder and a piston rod attached thereto and extending through the cylinder and pivotally attached to the flow control arm or lever while the head end of the cylinder is pivotally attached to a structural support to permit arcuate movement of the control valve lever;

(c) a spring within the cylinder at the head end capable of holding the piston at the rod end when subjecting the rod end of the cylinder to drilling pressure;

(d) a stop within the head end of the cylinder permitting the piston to travel sufficiently to change the valve position;

(e) piping connecting the fluid directed into the tool string to the rod end of the cylinder and an outlet from the head end of the cylinder to the pressures within the discharge conduit of the tool;

(f) means for increasing the hydraulic pressure of the fluid directed into the tool string which is applied to the rod end of the cylinder forcing the piston to travel toward the head end of the cylinder actuating the control valve.

22. A method according to claims, 20 or 21 wherein the actuating pressure is 350 psig or higher.

23. A slurry mining apparatus for slurrying an ore deposit and removing the ore comprising;

(a) a slurry mining tool with a discharge conduit within the tool string for conducting ore slurry to the surface and with a slurry entrance opening at the base of the tool communicating with the slurry return conduit;

(b) means of pumping slurry from the slurry entrance of the tool to the surface;

(c) a mining nozzle or nozzles extending transversely of the tool or at an acute angle with respect to the axis of the drill string and located below the eductor and adjacent to the slurry entrance to the tool;

(d) means of positioning the mining nozzle and slurry entrance of the tool at the ore deposit;

(e) means for rotating the tool string continuously or intermittently during mining;

(f) means of directing mining fluid into the tool string to slurry the ore matrix and to pump the ore to the surface.

24. An apparatus for recovering ore slurry through a sectionalized borehole mining tool with a discharge conduit within the tool string extending from the suction entrance to the uppermost section for conducting ore slurry to the surface and with a slurry entrance opening at the base of the tool communicating with the slurry return conduit; the borehole mining tool consisting of a mining nozzle section, a discharge conduit, and a slurry eductor pump wherein the slurry eductor pump is located intermediate of the mining nozzle section of the tool string and the uppermost section of the tool string.

25. An apparatus for recovering ore slurry through the discharge conduit of a borehole mining tool having in the discharge conduit an eductor pump consisting of a high velocity jet and a mixing throat wherein a flow restricting orifice is contained in the fluid supply conduit adjacent to the eductor jet nozzle.

* * * * *